US005925315A

United States Patent [19]

Bourkhina

[11] Patent Number: 5,925,315

[45] Date of Patent: Jul. 20, 1999

[54] ALUMINUM ALLOY WITH IMPROVED TRIBOLOGICAL CHARACTERISTICS

[75] Inventor: Anna N. Bourkhina, Moscow, Russian Federation

[73] Assignee: Caterpillar Inc., Peoria, Ill.

[21] Appl. No.: 08/875,545

[22] PCT Filed: Feb. 14, 1995

[86] PCT No.: PCT/US95/01843

§ 371 Date: Jul. 9, 1997

§ 102(e) Date: Jul. 9, 1997

[87] PCT Pub. No.: WO96/25527

PCT Pub. Date: Aug. 22, 1996

[51] Int. Cl.[6] ..... C22C 21/02; C22C 21/10; C22C 21/12

[52] U.S. Cl. ..... 420/530; 420/532; 420/534

[58] Field of Search ..... 420/530, 532, 420/534, 536, 537; 148/417, 439; 75/10.18, 10.64, 678, 686; 384/912, 913

[56] References Cited

U.S. PATENT DOCUMENTS

| | | | |
|---|---|---|---|
| 4,170,469 | 10/1979 | Mori . | |
| 4,452,866 | 6/1984 | Kamiya et al. | 428/653 |
| 5,320,803 | 6/1994 | Webster | 420/528 |
| 5,344,605 | 9/1994 | Kaji et al. | 419/31 |
| 5,405,578 | 4/1995 | Setzer et al. | 420/590 |

FOREIGN PATENT DOCUMENTS

| | | | |
|---|---|---|---|
| 58-117850 | 7/1983 | Japan . | |
| 59-104448 | 6/1984 | Japan | 21/2 |
| 1-272741 | 10/1989 | Japan . | |

*Primary Examiner*—Deborah Yee
*Attorney, Agent, or Firm*—Kevin M. Kercher

[57] ABSTRACT

An antifrictional aluminum alloy and a method for making an aluminum alloy without lead are provided. The alloy has improved tribological characteristics and a base composition, in weight percent as follows:

Silicon: 3.0–6.0
Copper: 2.0–5.0
Zinc: 0.5–5.0
Magnesium: 0.25–0.5
Nickel: 0.2–0.6
Tin: 0.5–5.0
Bismuth: 0.1–1.0
Iron: up to 0.7
Aluminum: essentially the balance.

18 Claims, No Drawings

ALUMINUM ALLOY WITH IMPROVED TRIBOLOGICAL CHARACTERISTICS

FIELD OF THE INVENTION

This invention is directed to a cast aluminum, antifrictional alloy for bearings and general purpose applications, and a method for making the alloy.

BACKGROUND OF INVENTION

For parts operating in frictional conditions, including movable bearings, it is extremely important to minimize the frictional characteristics of the metal while maintaining sufficient wear resistance and strength. Traditionally, lead containing aluminum alloys have been utilized in frictional environments. However, due to environmental concerns, there is a trend away from the use of lead. Also, restrictions on the use of lead are becoming more common.

SUMMARY OF THE INVENTION

The present invention relates generally to an aluminum-based alloy, and a method for producing an aluminum alloy having high wear resistance and superior anti-friction characteristics. The alloy of the present invention utilizes a composition and structure, containing hard and soft constituents, which makes it possible to reach the necessary compromise between wear-resistance, strength and anti-friction characteristics.

In addition, the present invention eliminates lead without significantly reducing the tribological characteristics of the alloy.

Further, the alloy of the present invention has significantly reduced copper requirements compared to prior art alloys. Therefore, the costs of the alloy of the present invention are lower.

DETAILED DESCRIPTION OF THE PRESENTLY PREFERRED EMBODIMENTS

In accordance with an embodiment of the invention, an aluminum-based alloy is provided having the following base composition, in weight percent:

| Element | General | Preferred |
|---|---|---|
| silicon (Si): | 3.0–6.0 | 4.0–5.5 |
| copper (Cu): | 2.0–5.0 | 3.0–4.5 |
| zinc (Zn): | 0.5–5.0 | 1.0–3.0 |
| magnesium (Mn): | 0.25–0.5 | 0.35–0.45 |
| tin (Sn): | 0.5–5.0 | 1.0–3.0 |
| bismuth (Bi): | 0.1–1.0 | 0.3–0.75 |
| aluminum (Al): | essentially the balance. | |

The alloy composition set forth above, also includes cobalt (Co), nickel (Ni) or molybdenum (Mo), or a mixture of these, in the amount of 0.1–1.0 wt %. Traces of iron, up to 0.7 wt %, may also be present due to the dispersion of iron from the kiln in which the alloy is created.

The unique aluminum alloy of the invention has a composition and structure containing hard and soft constituents, making it possible to achieve the necessary balance between good wear-resistance, high strength and excellent anti-friction characteristics.

The resulting alloy includes hard structural constituents formed from the above components, which increase the alloy strength, hardness, fatigue resistance, plastic deformation, and wear resistance. These hard constituents include, for example; Si, $Mg_2Si$, and $CuAl_2$. The alloy also includes soft constituents, for example, Sn and Bi, which decrease the friction coefficient, decrease the tendency to scuff and bond, and increase the alloy life under impaired lubrication conditions of friction surfaces and at a reduced thickness of oil layer.

The silicon, present at the levels recited above for the alloy, also provides improved casting properties, due to the formation of an aluminum-silicon-eutectic with a melting temperature of 577° C. In addition, the silicon increases alloy hardness, as stated above, increases static and fatigue strength, and increases wear resistance.

Copper, present at the levels recited above for the alloy, forms an intermetallic compound with the aluminum —$CuAl_2$—which has a variable solubility in a solid aluminum-based solution at different temperatures and can enter into the composition of iron-containing phases, including binary, ternary and more complex eutectics. Copper thereby promotes the increase in hardness, increases static and fatigue strength, increases fracture toughness, and increases resistance to plastic deformation and wear.

Zinc, present at the levels of an alloy of the present invention, is totally soluble in aluminum and does not form independent, separate phases, although it can be soluble in other phases. Zinc combines into alloys with tin and/or bismuth to form low melting eutectics of aluminum-zinc-tin or aluminum-zinc-tin-bismuth, having melting temperatures of which are within the ranges of 170–190° C. These low melting eutectics considerably increase the anti-friction properties of an alloy of the present invention.

Magnesium, present at the levels of an alloy of the present invention, mainly combines with silicon to form an intermetallic compound, $Mg_2Si$. This compound's alloy strengthening effect is similar to that of $CuAl_2$. But, $CuAl_2$ to a greater extent increases the alloy fatigue strength at cyclic loads, while $Mg_2Si$ provides higher strengthing at static. In addition, $Mg_2Si$ facilitates the product aluminum alloy's machinability through cutting.

Tin and bismuth, present at the levels of an alloy of the present invention, form in a monotectic type state with aluminum and do not dissolve, but mainly emanate to grain boundaries. These low melting point components reduce the alloy's friction coefficient and increase the alloy's resistance to scuffing and bonding in the contact areas of friction surfaces. This is accomplished by the formation of a sub-microscopic film of pure tin and bismuth which diffuses onto the part surface as temperatures increase due to boundary or dry friction.

To stabilize an alloy of the present invention at elevated temperatures, ingredients including nickel, molybdenum and/or cobalt can be introduced into the alloy composition. Molybdenum and/or cobalt are also introduced to reduce iron negative influence on the alloy properties: iron usually crystallizes forming big needle-shaped crystals. Molybdenum and/or cobalt, being dissolved in iron-containing phases, promote the change of the shapes of these phases crystals to the more compact crystals of Fe—Mo—Co phases, and, especially at elevated temperatures, increases the alloy's hardness, strength and wear resistance.

A preferred embodiment of the present invention has the following composition, in weight percent, silicon: 5.0
copper: 4.0
zinc: 2.0
magnesium: 0.4
nickel: 0.5 tin: 1.5
bismuth: 0.5
iron: 0.5
molybdenum: 0.3
cobalt: 0.3
aluminum: essentially the balance.

The alloy of the present invention can be produced in an induction furnace having an initial capacity of thirty (30) kilograms. Aluminum can be placed in the furnace and the temperature can be increased to 700° C. Once the temperature of the induction furnace has stabilized, silicon cab be added to result in the product alloy having 3–6 wt % silicon and a feed alloy of copper can be added to result in 2–5 wt % copper in the product alloy of the invention.

Either a molybdenum, nickel or cobalt alloy may also be added. Then zinc and tin can be added in their pure form. Bismuth is also added.

The copper alloy added to result in the specified weight percent of aluminum can be a 50/50 copper and aluminum alloy. The nickel alloy used to result in the specified weight percent can be 20% nickel and 80% aluminum. The molybdenum alloy added to result in the specified weight percent, if used, can be 10% molybdenum and 90% aluminum. Similarly, the cobalt alloy, if added, can be 10% cobalt and 90% aluminum.

After the above alloying elements have been added, the temperature of the induction furnace is increased to 730° C. and held between fifteen (15) and thirty (30) minutes.

The molten alloy blend can then be degassed and purified by adding fluorine or chloride tablets. Slag can then be removed. Once the slag is removed, magnesium can be added to the molten alloy. The molten alloy can then be degassed again.

The molten alloy can then be poured into iron casts that have been preheated to 100° C. The aluminum product can then be air cooled and cut into risers and gates. A final heat treat at 180° C. for six to eight hours completes the process.

While the embodiments of the invention disclosed here are presently considered preferred, various modifications and improvements can be made without departing from the spirit and scope of the invention. The scope of the invention is indicated in the appended claims, and all changes that fall within the meaning and range of equivalents are intended to be embraced therein.

What is claimed is:

1. An alloy consisting essentially of in wt %:
silicon: about 3.0–6.0
copper: about 2.0–5.0
zinc: about 1.5–5.0
magnesium: about 0.25–0.5
tin: about 0.5–5.0
bismuth: about 0.1–1.0
aluminum: essentially the balance.

2. The alloy of claim 1 consisting essentially of silicon at about 4.0–5.5% by weight.

3. The alloy of claim 1 consisting essentially of copper at about 3.0–4.5% by weight.

4. The alloy of claim 1 consisting essentially of zinc at about 1.0–3.0% by weight.

5. The alloy of claim 1 consisting essentially of magnesium at about 0.35–0.35% by weight.

6. The alloy of claim 1 consisting essentially of nickel at about 0.35–0.55% by weight.

7. The alloy of claim 1 consisting essentially of tin at about 1.0–3.0% by weight.

8. The alloy of claim 1 consisting essentially of bismuth at about 0.3–0.75% by weight.

9. The alloy of claim 1 consisting essentially of 0.1–1.0 wt % of an ingredient selected from the group consisting of cobalt, nickel or molybdenum, and combinations thereof.

10. The alloy of claim 9, consisting essentially of cobalt.

11. The alloy of claim 9, consisting essentially of nickel.

12. The alloy of claim 9, consisting essentially of molybdenum.

13. The aluminum based alloy of claim 9, wherein said ingredient is present at about 0.2–0.6% by weight.

14. An alloy consisting essentially of in wt %:
silicon: about 4.5–5.5
copper: about 3.5–4.5
zinc: about 1.5–3.0
magnesium: about 0.35–0.45
tin: about 1.0–3.0
bismuth: about 0.3–0.7
aluminum: essentially the balance.

15. An alloy of claim 14, further consisting essentially of about 0.1–1.0 wt % of an ingredient selected from the group consisting of cobalt, nickel or molybdenum, and combinations thereof.

16. The aluminum based alloy of claim 15, wherein said ingredient is present at about 0.2–0.6% by weight.

17. An alloy of claim 15, consisting essentially of in wt %:
silicon: about 5.0
copper: about 4.0
zinc: about 2.0
magnesium: about 0.4
nickel: about 0.5
tin: about 1.5
bismuth: about 0.5
iron: about 0.5
molybdenum: about 0.3
cobalt: about 0.3
aluminum: essentially the balance.

18. A bearing consisting essentially of an alloy including the following ingredients in wt %:
silicon: about 3.0–6.0
copper: about 2.0–5.0
zinc: about 1.5–5.0
magnesium: about 0.25–0.5
tin: about 0.5–5.0
bismuth: about 0.1–1.0
aluminum: essentially the balance.

* * * * *